US010130146B2

(12) United States Patent
Kolasa et al.

(10) Patent No.: US 10,130,146 B2
(45) Date of Patent: Nov. 20, 2018

(54) SIDE-RELEASE BUCKLE ASSEMBLY

(71) Applicant: ILLINOIS TOOL WORKS INC., Glenview, IL (US)

(72) Inventors: Scott D. Kolasa, Mount Prospect, IL (US); David A. Shereyk, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 134 days.

(21) Appl. No.: 14/759,430

(22) PCT Filed: Dec. 26, 2013

(86) PCT No.: PCT/US2013/077807

§ 371 (c)(1),
(2) Date: Jul. 7, 2015

(87) PCT Pub. No.: WO2014/109911

PCT Pub. Date: Jul. 17, 2014

(65) Prior Publication Data

US 2015/0351500 A1 Dec. 10, 2015

Related U.S. Application Data

(60) Provisional application No. 61/751,304, filed on Jan. 11, 2013, provisional application No. 61/805,227, filed on Mar. 26, 2013.

(51) Int. Cl.
*A44B 11/25* (2006.01)
*A44B 11/26* (2006.01)

(52) U.S. Cl.
CPC ..... *A44B 11/266* (2013.01); *A44B 11/2592* (2013.01); *Y10T 24/45529* (2015.01); *Y10T 24/45958* (2015.01); *Y10T 24/45995* (2015.01)

(58) Field of Classification Search
CPC ..... A44B 11/266; A44B 11/2592
See application file for complete search history.

(56) References Cited

U.S. PATENT DOCUMENTS 4,688,337 A * 8/1987 Dillner ..... A44B 11/266 24/615
4,713,865 A * 12/1987 Geldwerth ..... A44B 11/266 24/615
4,800,629 A * 1/1989 Ikeda ..... A44B 11/005 24/170

(Continued)

FOREIGN PATENT DOCUMENTS

CN 2901963 Y 5/2007
CN 101505627 A 8/2009

(Continued)

OTHER PUBLICATIONS

ISR and WO for PCT/US2013/077807 dated Mar. 5, 2014.
Office Action for counterpart German application 11 2013 004 928.7, dated Sep. 26, 2017.

*Primary Examiner* — Jason W San
(74) *Attorney, Agent, or Firm* — Joseph M. Butscher; The Small Patent Law Group, LLC

(57) ABSTRACT

A buckle assembly may include a first connection member, and a second connection member configured to receive at least a portion of the first connection member in order to removably connect the first connection member to the second connection member. The second connection member includes an outer frame defining a central opening that is configured to allow monitoring of alignment and connection between the first and second connection members.

15 Claims, 9 Drawing Sheets

(56) References Cited

U.S. PATENT DOCUMENTS

| | | | | | |
|---|---|---|---|---|---|
| 5,311,649 | A * | 5/1994 | Suh | A44B 11/266 | 24/616 |
| 5,465,472 | A * | 11/1995 | Matoba | A44B 11/266 | 24/616 |
| 6,560,830 | B1 * | 5/2003 | Chi | A44B 11/266 | 24/616 |
| 7,089,633 | B2 * | 8/2006 | Liu | A44B 11/266 | 24/615 |
| 7,181,936 | B2 * | 2/2007 | Christensen | A44B 11/266 | 70/389 |
| 8,112,850 | B2 * | 2/2012 | Uehara | A44B 11/266 | 24/197 |
| 9,015,912 | B2 * | 4/2015 | Nanbu | A44B 11/266 | 24/615 |
| 2010/0306976 | A1 * | 12/2010 | Kaneko | A44B 11/266 | 24/700 |
| 2012/0017407 | A1 * | 1/2012 | Uehara | A44B 11/266 | 24/700 |
| 2015/0135494 | A1 * | 5/2015 | Kataguchi | A44B 11/266 | 24/697.1 |
| 2015/0143675 | A1 * | 5/2015 | Nanbu | A44B 11/266 | 24/697.1 |
| 2015/0237972 | A1 * | 8/2015 | Kolasa | A44B 11/26 | 24/197 |
| 2015/0351500 | A1 * | 12/2015 | Kolasa | A44B 11/266 | 24/615 |
| 2016/0366989 | A1 * | 12/2016 | Kolasa | A44B 11/006 | |

FOREIGN PATENT DOCUMENTS

| | | | |
|---|---|---|---|
| DE | 11 2009 004 61 | | 5/2012 |
| EP | 2415365 | A1 | 2/2012 |
| GB | 2138879 | A | 10/1984 |
| WO | WO 2008/045695 | | 4/2008 |

* cited by examiner

SIDE-RELEASE BUCKLE ASSEMBLY

RELATED APPLICATIONS

This application is a National Phase of PCT/US2013/077807 filed Dec. 26, 2013 and relates to and claims priority benefits from U.S. Provisional Patent Application No. 61/751,304 filed Jan. 11, 2013, and U.S. Provisional Patent Application No. 61/805,227 filed Mar. 26, 2013, both of which are hereby incorporated by reference in their entireties.

FIELD OF THE DISCLOSURE

Embodiments of the present disclosure generally relate to buckle assemblies, and more particularly to side-release buckle assemblies.

BACKGROUND OF THE DISCLOSURE

A conventional side-release buckle assembly includes a male connection member that is configured to mate with a female connection member, such as shown and described in U.S. Pat. No. 5,465,472, entitled "Buckle." Each connection member is configured to retain a strap, such as a seatbelt or backpack strap. The male connection member includes integral buttons that may be engaged to release the male connection member from the female connection member, thereby disconnecting the buckle assembly.

FIG. 1 illustrates a top view of a disconnected conventional buckle assembly 10. The buckle assembly 10 includes a male connection member 12 and a female connection member 14. The male connection member 12 includes a pair of flexible lateral arms 16 having buttons 18 at distal ends 20. A rigid strut member 22 extends between the lateral arms 16. A strap-receiving channel 21 is formed through the male connection member 12 between the rigid strut member 22 and a strap bar 23, which is configured to clamp into a strap. The lateral arms 16 are configured to pivot in the direction of arcs A and A' about pivot points 24 defined by the union of the rigid strut member 22 and the lateral arms 16. In general, the rigid strut member 22 is disposed between the pivot points 24 and the strap-receiving channel 21. As such, the pivot points 24 are distally located from the strap bar 23. As shown in FIG. 1, the rigid strut member 22 extends between the lateral arms 16 and is integrally connected to a main body 25 of the male connection member 12.

In order to secure the male connection member 12 into the female connection member 14, the male connection member 12 is urged into the female connection member 14 in the direction of arrow B. A guide beam 26 of the male connection member 12 moves into a reciprocal channel (not shown) formed in the female connection member 14 to ensure proper mating alignment between the male and female connection members 12 and 14, respectively. As the male connection member 12 is urged into the female connection member 14, the lateral arms 16 deflect inwardly in the directions of arcs A and A' until the buttons 18 reach button openings 28 formed through the female connection member 14. When the buttons 18 enter the button openings 28, the tension stored in the lateral arms 16 snapably forces the lateral arms 16 and the buttons laterally outward, so that the buttons 18 are secured within the button openings 28. At this point, the male connection member 12 is secured to the female connection member 14.

FIG. 2 illustrates a top view of the conventional buckle assembly 10 in which the male connection member 12 is securely mated into the female connection member 14. In order to disconnect the male connection member 12 from the female connection member 14, the buttons 18 are squeezed toward one another in the direction of arcs A and A'.

As shown in FIGS. 1 and 2, the female connection member 14 generally includes a solid shroud that covers the connection interface between the male and female connection members 12 and 14. An outer surface of the female connection member 14 is generally solid and contiguous. Typically, buckle assemblies include an outer surface that covers the connection interface between the separate components of the buckle assemblies. Therefore, the buckle assemblies may be or at least appear bulky and heavy.

Further, the male connection member 12 may not be properly aligned with the female connection member 14 during the mating process. As such, the male connection member 12 may not properly connect with the female connection member 14, and/or the male connection member 12 may jam with respect to the female connection member 14. Further, in certain conditions, some conventional buckle assemblies, such as the buckle assembly 10, may become clogged with debris, snow, or the like, rendering connection difficult. That is, snow or other debris may become trapped within the female connection member 14, thereby rendering full and proper mating with the male connection member 12 difficult or impossible.

SUMMARY OF THE DISCLOSURE

Certain embodiments of the present disclosure provide a buckle assembly that may include a first connection member, and a second connection member configured to receive at least a portion of the first connection member in order to removably connect the first connection member to the second connection member. The second connection member may include an outer frame defining a central opening that is configured to allow monitoring of alignment and connection between the first and second connection members.

The central opening may be formed through at least a portion of a central axis of the second connection member. The central opening may extend on all sides of the central axis. In at least one embodiment, the central opening may extend over at least half the length and over at least half the width of the second connection member.

The first connection member may include a guide channel defined between first and second prongs. The second connection member may include a central guide configured to be received by the guide channel in order to align the first connection member with the second connection member. In at least one embodiment, the central guide may extend into the central opening. In at least one embodiment, the central guide includes opposed panels connected together by a central fin.

The first connection member may include opposed locking arms configured to removably secure to reciprocal features of the second connection member. The second connection member may include opposed pivotal release buttons configured to be engaged to remove the opposed locking arms from the reciprocal features. Each of the opposed pivotal release buttons may include a flexible extension beam that connects to an arm-engaging beam through a transition joint. A hook may be formed at a distal end of the arm-engaging beam. The hook may be configured to abut into a ledge of the second connection member when the opposed pivotal release buttons are disengaged.

The outer frame may include interior walls that are configured to align the first connection member with the second connection member when the first connection member is mated with the second connection member. The interior walls may include inwardly-curved lateral walls.

Certain embodiments of the present disclosure provide a buckle assembly that may include a female connection member configured to receive at least a portion of a male connection member in order to removably connect the male connection member to the female connection member. The female connection member may include an outer frame defining a central opening that is configured to allow monitoring of alignment and connection between the male and female connection members when the male connection member is mated with the female connection member.

Figure 1:
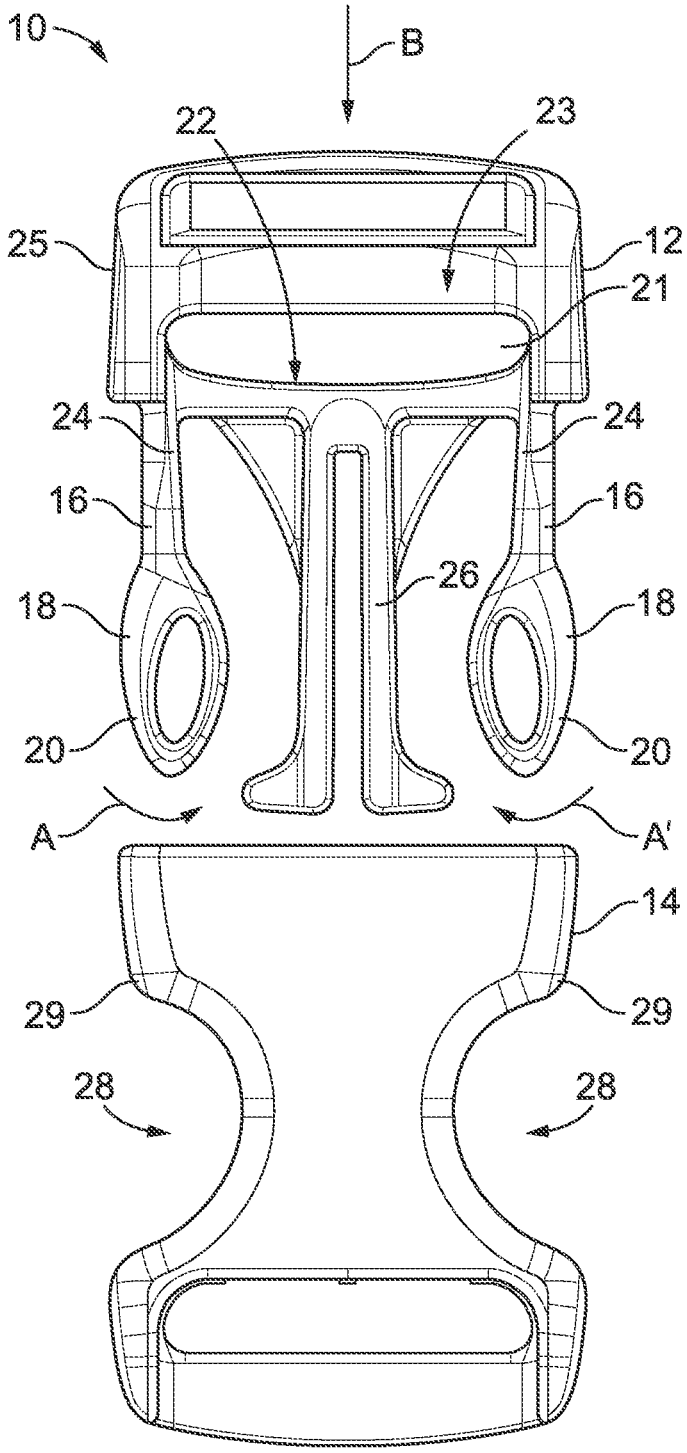
FIG. 1 (Prior Art)
FIG. 1 illustrates a top view of a disconnected conventional buckle assembly.
Figure 2:
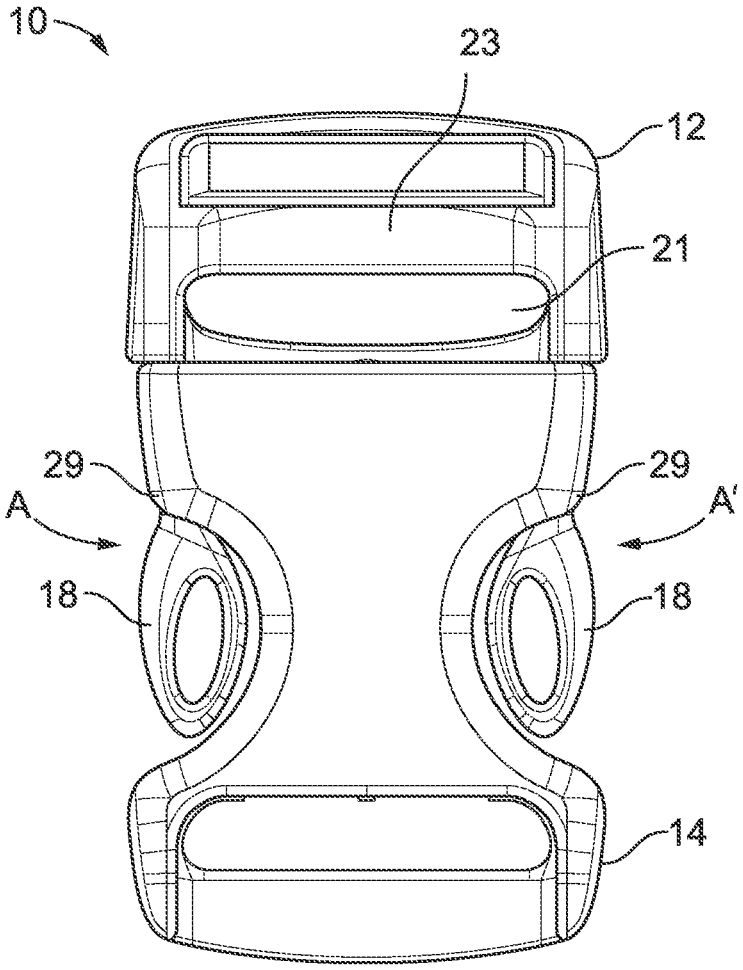
FIG. 2 (Prior Art)
FIG. 2 illustrates a top view of a conventional buckle assembly.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION M DISCLOSURE

Figure 3:
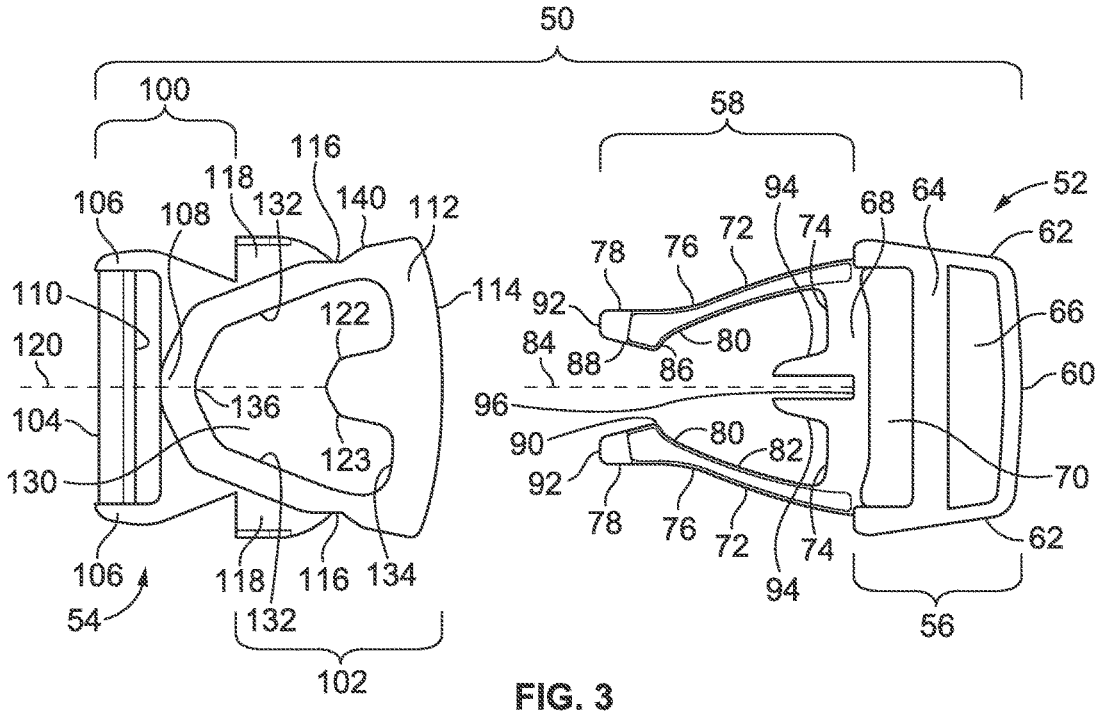
FIG. 3 illustrates a top view of a buckle assembly in a disconnected state, according to an embodiment of the present disclosure.
Figure 4:
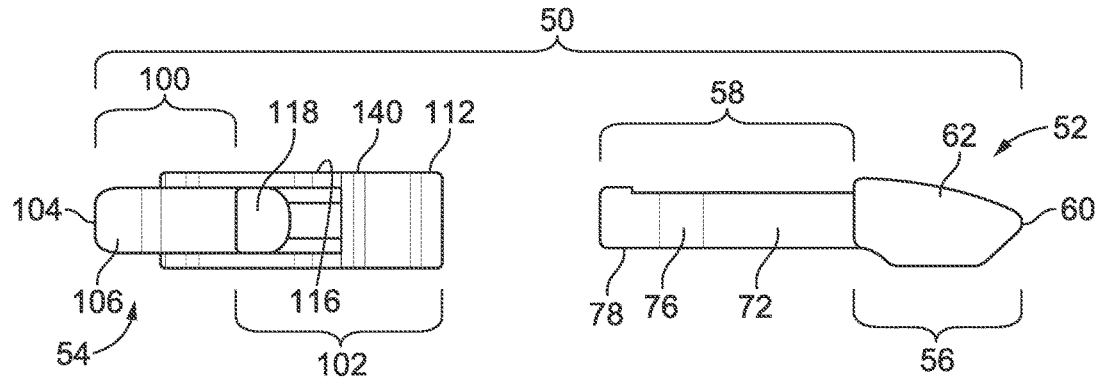
FIG. 4 illustrates a lateral view of a side-release buckle assembly in a disconnected state, according to an embodiment of the present disclosure.
Figure 5:
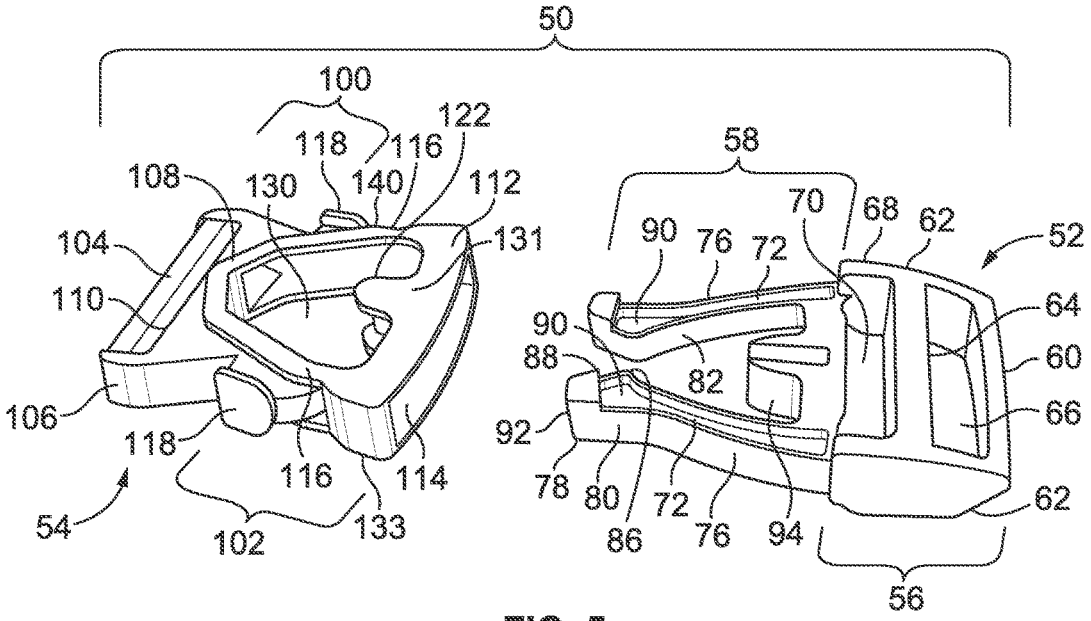
FIG. 5 illustrates an isometric top view of a side-release buckle assembly in a disconnected state, according to an embodiment of the present disclosure.

FIG. 3 illustrates a top view of a side-release buckle assembly 50 in a disconnected state, according to an embodiment of the present disclosure. FIG. 4 illustrates a lateral view of the side-release buckle assembly 50 in the disconnected state, while FIG. 5 illustrates an isometric top view of the side-release buckle assembly 50 in the disconnected state. Referring to FIGS. 3-5, the buckle assembly 50 includes a first or male connection member 52, such as a latch, that is configured to removably secure to a second or female connection member 54, such as a receiving body. Each of the male and female connection members 52 and 54, respectively, may be integrally molded and formed as a single piece. For example, each of the male and female connection members 52 and 54 may be integrally formed in a mold through a process of injection-molding. As an example, each of the male and female connection members 52 and 54 may be formed as a single piece of injection-molded plastic. Alternatively, the male and female connection members 52 and 54 may be formed of various other materials, such as metal, and may include separate and distinct components that are fastened or otherwise secured together.

The male connection member 52 includes a web-receiving end 56 integrally formed and connected with an insertion end 58. The web-receiving end 56 includes an end wall 60 connected to perpendicular lateral walls 62, which, in turn, connect to an interior beam 64. A recessed area 66 may be defined between the end wall 60, the lateral walls 62, and the interior beam 64. The recessed area 66 provides a male connection member 52 having reduced mass. Alternatively, the male connection member 52 may not include the recessed area 66.

The lateral walls 62 extend past the interior beam 64 and connect to a cross strut 68 of the insertion end 58. A web channel 70 is formed between the interior beam 64, the lateral walls 62 and the cross strut 68. The web channel 70 is configured to slidably receive and retain a portion of webbing or a strap.

Opposed locking arms 72 extend from opposite sides 74 of the cross strut 68. Each locking arm 72 includes an inwardly canted extension beam 76 having a locking tip 78 at a distal end 80. Inner surfaces 82 of the extension beams 76 curve toward a central axis 84 of the male connection member 52. Each locking tip 78 includes a base edge 86 that bends toward the central axis 84. The base edge 86 connects to a flat interior edge 88 at an apex 90. The interior edge 88 connects to distal flat edge 92 that may be parallel with the cross strut 68.

Opposed central prongs 94 extend from the cross strut 68 on either side of the central axis 84. A guide channel 96 is defined between the central prongs 94. As shown in FIG. 1, the central prongs 94 extend from areas proximate to the central axis 84, while the opposed locking arms 72 extend from opposite sides 74 of the cross strut 68. The opposed locking arms 72 may be longer than the central prongs 94, as shown in FIGS. 3 and 5, in particular. For example, the opposed locking arms 72 may be three or more times as long as the central prongs 94. Alternatively, the opposed locking arms 72 and the central prongs 94 may be shorter or longer than shown. Also, alternatively, the male connection member 52 may not include the central prongs 94.

The female connection member 54 includes a web-receiving end 100 integrally formed and connected with a male-receiving end 102. The web-receiving end 100 includes an end wall 104 connected to perpendicular lateral walls 106, which, in turn, connect to an interior beam 108. A web channel 110 is formed between the end wall 104, the lateral walls 106, and the interior beam 108. The web channel 110 is configured to slidably receive and retain a portion of webbing or a strap.

The male-receiving end 102 includes a receiving sleeve 112 defining a passage 114 configured to receive the insertion end 58 of the male connection member 52. The receiving sleeve 112 is integrally connected to lateral walls 116 that connect to the interior beam 108. Pivotal release buttons 118 outwardly extend from the lateral walls 116 and are configured to pivot toward and away from a central axis 120 of the female connection member 54.

A central guide 122 extends inwardly from the receiving sleeve 112 toward the interior beam 108 and is configured to slidably receive the guide channel 96 defined between the central prongs 94 of the male connection member 52. The guide 122 may include upper and lower panels 123 that connect to a central fin (hidden from view in FIG. 3) therebetween. The central fin may be perpendicular to the upper and lower panels 123 and may extend between central axes of the upper and lower panels 123. The guide 122 and the guide channel 96 are configured to cooperate to ensure proper aligned connection between the male connection member 52 and the female connection member 54.

As shown, the male-receiving end 102 includes a central opening 130 that is formed through an entire depth of the female connection member 54 from a top surface 131 to a bottom surface 133. That is, the central opening 130 is formed completely through the female connection member 54. The central opening 130 is defined between interior surfaces 132 of the lateral walls 116, an interior surface 134 of the receiving sleeve 112, and an interior surface 136 of the interior beam 108. As such, instead of a shroud, the receiving sleeve 112, the lateral walls 116, and the interior beam 108 form an outer perimeter frame 140 that defines the central opening 130.

The central opening 130 is formed through a central portion of the female connection member 54. As shown, the central opening 130 occupies a majority of the male-receiving end 102 of the female connection member 54. The central opening 130 is formed through at least a portion of the central axis 120 and extends on both sides thereof. As shown in FIG. 1, the central opening 130 may extend over half the length and over half the width of the female connection member 54. For example, the central opening 130 may extend between 60-75% of the length and 60-75% of the width of the female connection member 54. Alternatively, the central opening 130 may extend over greater or lesser portions of the length and width of the female connection member 54. The central opening 130 provides a window into the female connection member 54 that allows an individual to view a mating process between the male connection member 52 and the female connection member 52 to ensure a proper aligned connection.

Figure 6:
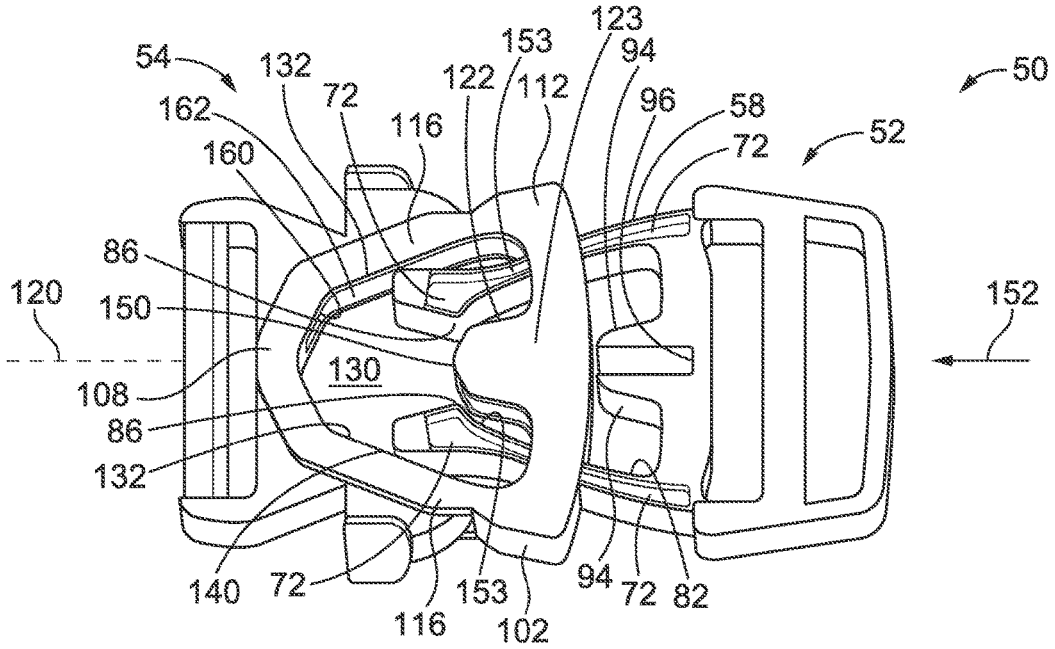
FIG. 6 illustrates a top view of a male connection member being inserted into a female connection member, according to an embodiment of the present disclosure.

FIG. 6 illustrates a top view of the male connection member 52 being inserted into the female connection member 54, according to an embodiment of the present disclosure. In order to connect the male connection member 52 with the female connection member 54, the male connection member 52 is aligned with the female connection member 54 such that the guide channel 96 between the central prongs 94 is aligned with the central fin 150 of the of the guide 122 of the female connection member 54. The insertion end 58 of the male connection member 52 is then urged into the male-receiving end 102 in the direction of arrow 152 via the passage 114 (shown in FIGS. 3 and 5) of the receiving sleeve 112. The guide channel 96 of the male connection member 52 and the guide 122 of the female connection member 54 cooperate to ensure that the male connection member 52 is properly aligned with the female connection member 54. The central fin 150 ensures that the prongs 94 are properly axially aligned with respect to the longitudinal axis 120 of the female connection member 54, while the upper and lower panels 123 of the guide 122 prevents the prongs 94, and therefore the male connection member 52, from upwardly or downwardly pivoting (in relation to the view shown in FIG. 6) with respect to the female connection member 54.

As the male connection member 52 is urged into the female connection member 54, the opposed locking arms 72 are squeezed together as they slide over the inwardly curved interior surfaces 132 of the lateral walls 116 of the female connection member 54. The opposed locking arms 72 continue to be squeezed together until they reach interior passages 160 formed proximate to the junction between the lateral walls 116 and interior beam 108. Once the locking tips 78 pass into the passages 160 and the base edges 86 pass therein, the opposed locking arms 72 expand back to their at-rest positions, and the base edges 86 securely latch onto ledges 162 defining a portion of the interior passages 160. As such, the opposed locking arms 72 securely lock onto the ledges 162, and the male connection member 52 is securely connected to the female connection member 54.

Additionally, as shown in FIG. 6, each locking arm 72 may include an upstanding rim 153 that extends along the inner surface 82. The upstanding rim 153 strengthens the locking arm 72 and allows for a smooth, guarded release of the male connection member 52 from the female connection member 54. The upstanding rim 153 provides strength, as well as guards the locking arms 72 from catching on the central opening 130 during a disconnection process.

Figure 7:
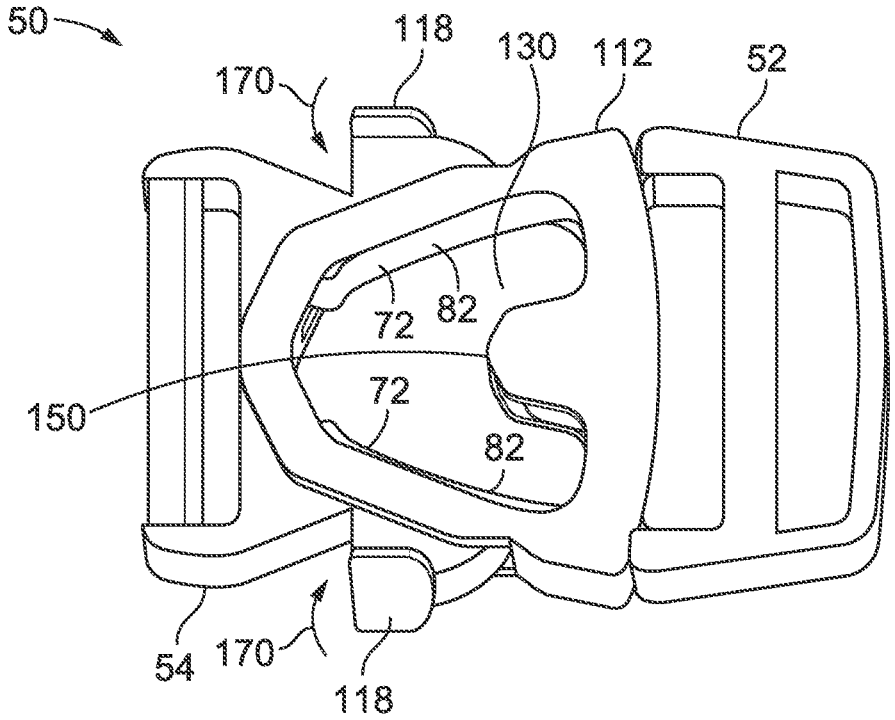
FIG. 7 illustrates a top view of a side-release buckle assembly in a connected state, according to an embodiment of the present disclosure.

FIG. 7 illustrates a top view of the side-release buckle assembly 50 in a connected state, according to an embodiment of the present disclosure. As shown in FIG. 7, the opposed locking arms 72 are in their at-rest positions, such that the locking tips 78 (shown in FIG. 6, but hidden from view in FIG. 7) are securely locked onto the ledges 162 (shown in FIG. 6, but hidden from view in FIG. 7).

As shown in FIG. 7, the central opening 130 of the female buckle member 54 allows an individual to see through the buckle assembly 10. The central opening 130 exposes the interior surface 82 of the opposed locking arms 72 in the connected state. Moreover, the central opening 130 prevents debris, snow, and the like from being trapped within the buckle assembly 50.

In order to disconnect the male buckle member 52 from the female buckle member 54, the pivotal release buttons 118 of the female buckle member 54 are pressed and pivoted inwardly in the directions of arc 170. As the pivotal release buttons 118 are pivoted toward the central opening 130, the pivotal release buttons 118 contact the locking tips 78 of the opposed locking arms 72 and force the locking tips 78 off of the ledges 162. Because the pivotal release buttons 118 pivot inwardly and toward the receiving sleeve 112 in the directions of arc 170, the movement of the pivotal release buttons 118 not only forces the locking tips 86 off the ledges 162, but also moves the locking tips 78, and therefore the opposed locking arms 72, into a retreat toward the receiving sleeve 112, as shown in FIG. 6. In this manner, the male connection member 52 may be disconnected from the female connection member 54 and may be removed therefrom.

Figure 8:
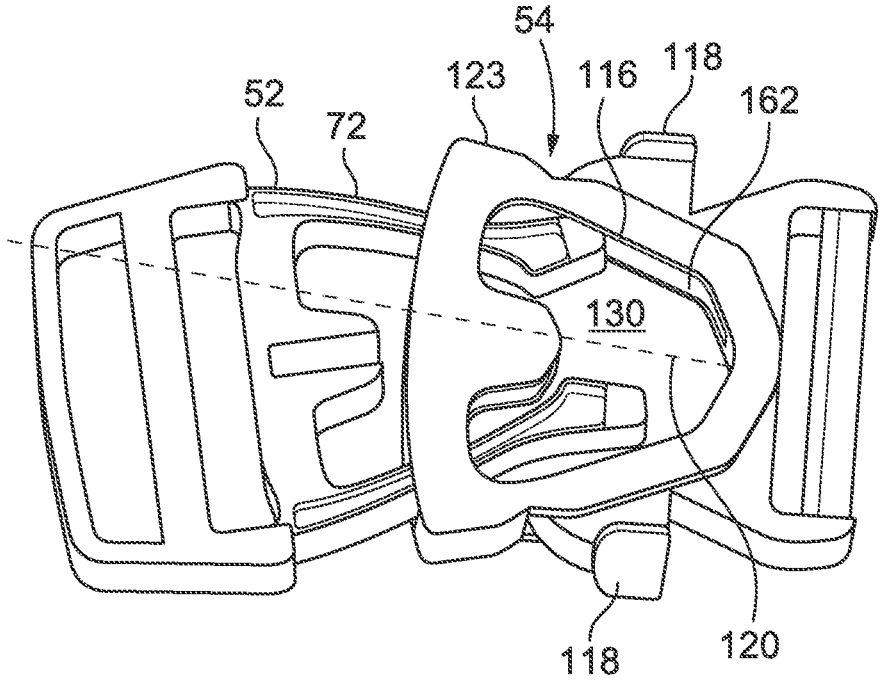
FIG. 8 illustrates an isometric top view of a male connection member being inserted into the female connection member at an angle that deviates from the central longitudinal axis of the female connection member, according to an embodiment of the present disclosure.

FIG. 8 illustrates an isometric top view of a male connection member 52 being inserted into the female connection member 54 at an angle that deviates from the central longitudinal axis 120 of the female connection member 54, according to an embodiment of the present disclosure. When the male connection member 52 is inserted into the female connection member 54 at a mis-aligned angle, the inwardly curved nature of the lateral walls 116 of the female connection member 54 exerts a force into one of the locking arms 72 that tends to move the male connection member 52 back toward the central axis 120. As the male connection member 52 continues to be urged into the female connection member, the lateral walls 116 curve further toward the central axis 120, thereby exerting an increased force that opposes the magnitude and direction of insertion of the male connection member 52. As such, the lateral walls 116 exert increased force into the locking arm 72 that tends to move the male connection member 52 into proper alignment.

Figure 9:
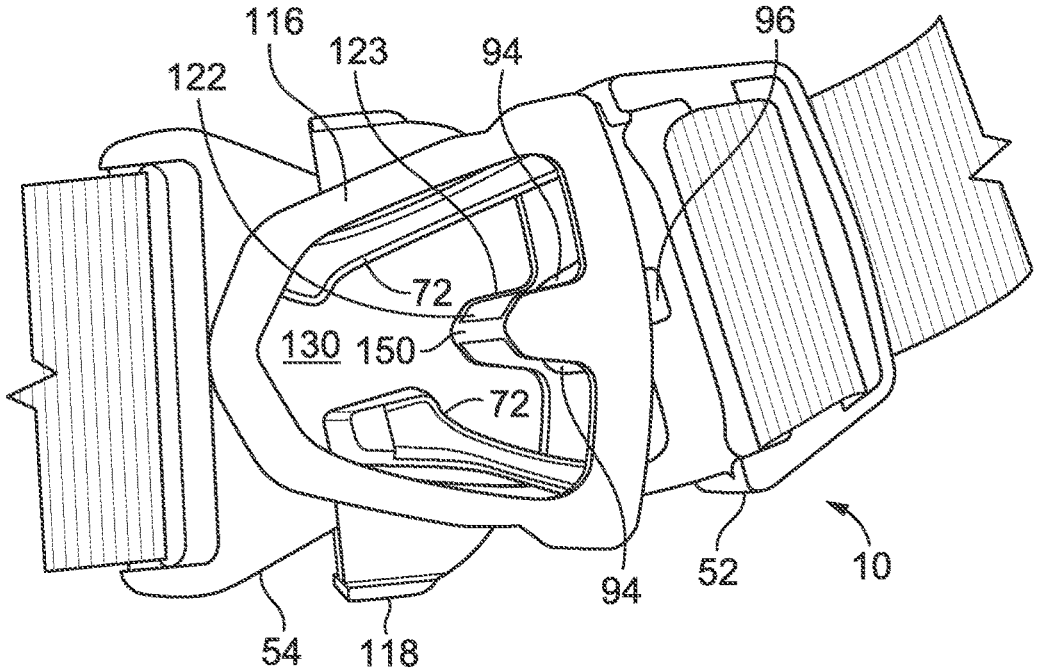
FIG. 9 illustrates an isometric view of a guide rib of a female connection member cooperating with a guide passage of a male connection member to properly orient the male connection member with respect to the female connection member, according to an embodiment of the present disclosure.

FIG. 9 illustrates an isometric view of the guide 122 of the female connection member 54 cooperating with the guide channel 96 of the male connection member 52 to properly orient the male connection member 52 with respect to the female connection member 54, according to an embodiment of the present disclosure. As shown, even if the male connection member 52 is improperly aligned with the female connection member 54, the prongs 94 may engage around the central fin 150 of the guide 122 such that the guide channel 96 receives the fin 150. With further insertion of the male connection member 52 into the female connection member 54, the stiff prongs 94 automatically center about the fin 150. Consequently, the male connection member 52 is automatically shifted to a proper center alignment with respect to the female connection member 54. Moreover, the guide 122 acts as a stop for the male connection member 52 to wedge up against if one arm is released, thereby allowing the male connection member 52 to stay locked to the female connection member 54 with just one locking arm 72. For example, if only one pivotal release arm 118 is engaged, one of the locking arms 72 may disengage from secure connection, but the other locking arm 72 remains securely locked to the female connection member 54, as the asymmetrical force exerted into the male connection member 52 may cause the prongs 94 to securely wedge into the fin 150.

Referring to FIGS. 8 and 9, the curved interior walls 116 and guide 122 of the female connection member 54 cooperate with the locking arms 72 and the stiff prongs 94 of the male connection member 52 to ensure that the male connection member 52 properly aligns and connects with the female connection member 54. The central opening 130 formed through the female connection member 54 allows an individual to view the mating connection process to ensure proper alignment between the female connection member 54 and the male connection member 52.

Referring to FIGS. 3-9, in general, the central opening 130 formed through the female connection member provides a window that allows an individual to view the alignment and connection process to ensure that the male connection member 52 properly connects to the female connection member 54. Further, the central opening 130 provides an assembly having less material and less weight as compared to typical buckles.

Embodiments of the present disclosure provide the buckle assembly 50 including the female connection member 54 having the central opening 130, thereby providing the buckle assembly 50 with a lightweight, airy frame-style configuration. The central opening 130 provides a guiding window during mating and connection. Further, the curved lateral walls 116 and the guide 122 ensure proper alignment during a mating and connection process.

Figure 10:
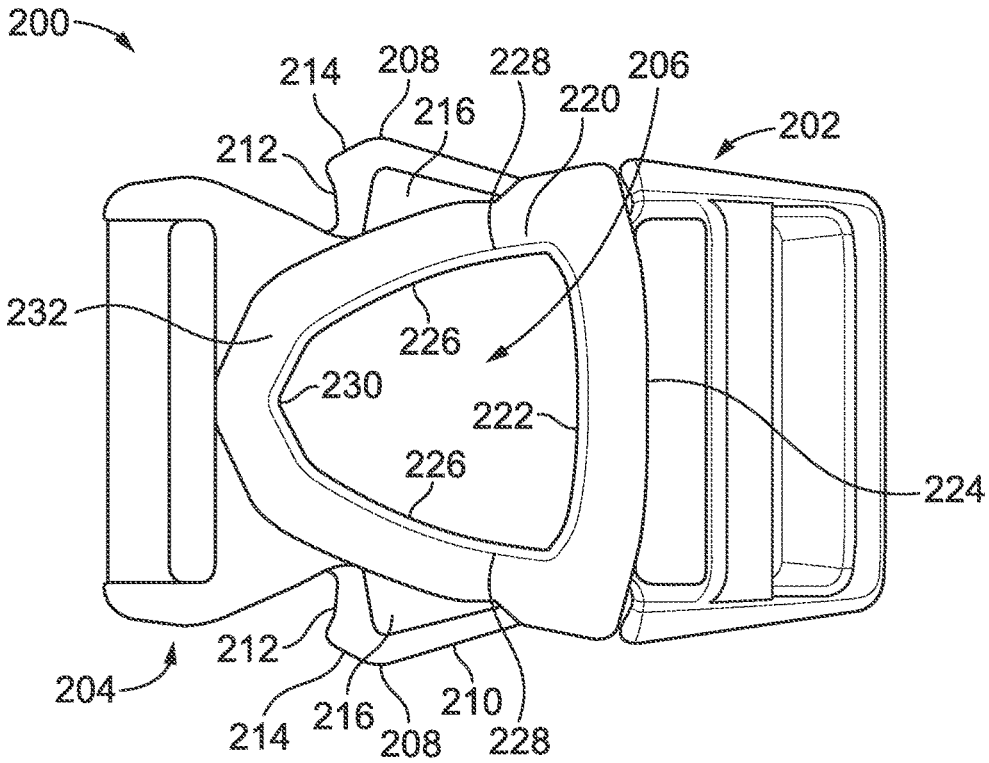
FIG. 10 illustrates a top view of a side-release buckle assembly in a connected state, according to an embodiment of the present disclosure.

FIG. 10 illustrates a top view of a side-release buckle assembly 200 in a connected state, according to an embodiment of the present disclosure. The buckle assembly 200 includes a male connection member 202 that is configured to be removably connected to a female connection member 204. The male connection member 202 may be similar to the male connection member 52 described above.

The female connection member 204 may be similar to the female connection member 54 described above. However, a central guide may not extend into the central opening 206 of the female connection member 54. Additionally, pivotal release buttons 208 of the female connection member 54 may include a flexible extension beam 210 that connects to an arm-engaging beam 212 through a transition joint 214. An opening 216 is defined between the flexible extension beam 210, the arm-engaging beam 212, and the transition joint 214. The opening 216 decreases the overall weight of the assembly 200.

As shown in FIG. 10, the central opening 206 is defined by an outer perimeter frame 220 that includes a linear inner surface 222 of a receiving sleeve 224, interior surfaces 226 of opposed lateral walls 228, and an interior surface 230 of an interior beam 232.

Figure 11:
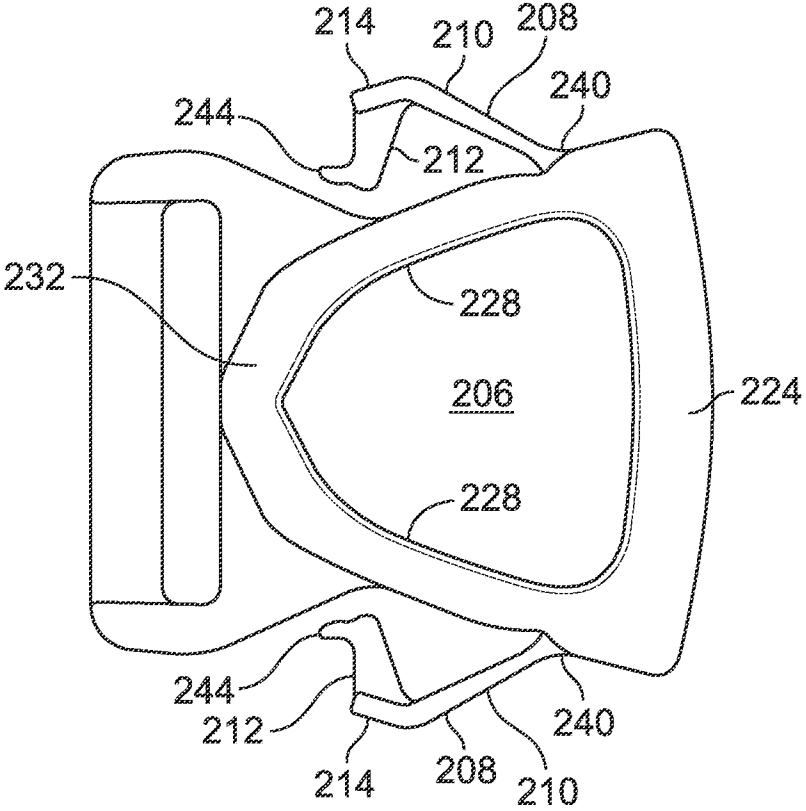
FIG. 11 illustrates a top view of a female connection member as initially formed, according to an embodiment of the present disclosure.

FIG. 11 illustrates a top view of the female connection member 204 as initially formed, according to an embodiment of the present disclosure. When initially formed, such as through a molding process, the flexible extension beams 210 include roots 240 that flexibly connect to lateral portions of the receiving sleeve 224. The arm-engaging beam 212 may be free from lateral walls 228. Distal ends of the arm-engaging beams 212 include hooks 244 that are configured to be movably secured within the lateral walls 228.

Figure 12:
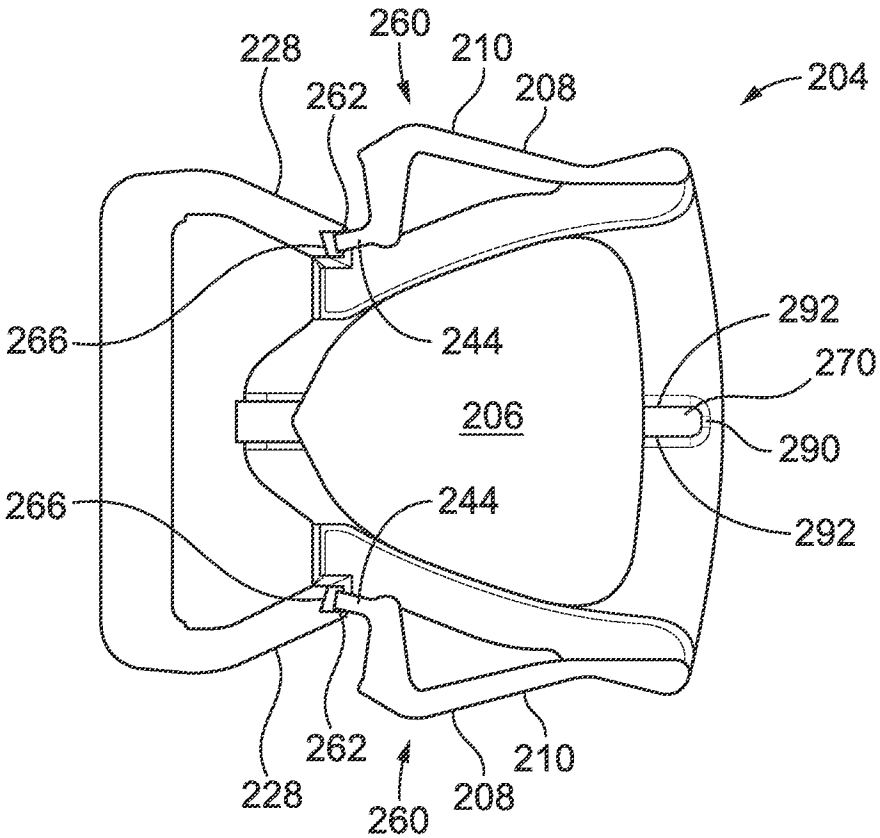
FIG. 12 illustrates an interior view of a female connection member, according to an embodiment of the present disclosure.

FIG. 12 illustrates an interior view of the female connection member 204, according to an embodiment of the present disclosure. In order to fully form the female connection member 204, the flexible extension beams 208 are squeezed inwardly in the direction of arrows 260 so that the hooks 244 clear internal ledges 262 formed within the lateral walls 228. As the squeezing pressure is released, the flexible extension beams 208 expand back to their at-rest positions, but the hooks 244 nest within slots or recesses 266 and are prevented from further movement by the ledges 262. As such, the pivotal release buttons 208 may be squeezed inwardly (such as to engage locking arms of a male connection member), but outward movement is limited by the interface between the hooks 244 and the ledges 262.

The hooks 244 are secured from outward movement by the ledges 262. As such, the pivotal release buttons 208 are less susceptible to catching or snagging on miscellaneous objects, such as fabric, webbing. Further, the interface between the hooks 244 and the ledges 262 protects the pivotal release buttons 208 from snapping off about the pivotal or flexible root.

Additionally, as shown in FIG. 12, a central guide 270 extends within the receiving sleeve 224. The central guide 270 may not extend into the central opening 206. The central guide 270 is configured to be received by a guide channel in a male connection member in order to properly align the male connection member with the female connection member 204.

Figure 13:
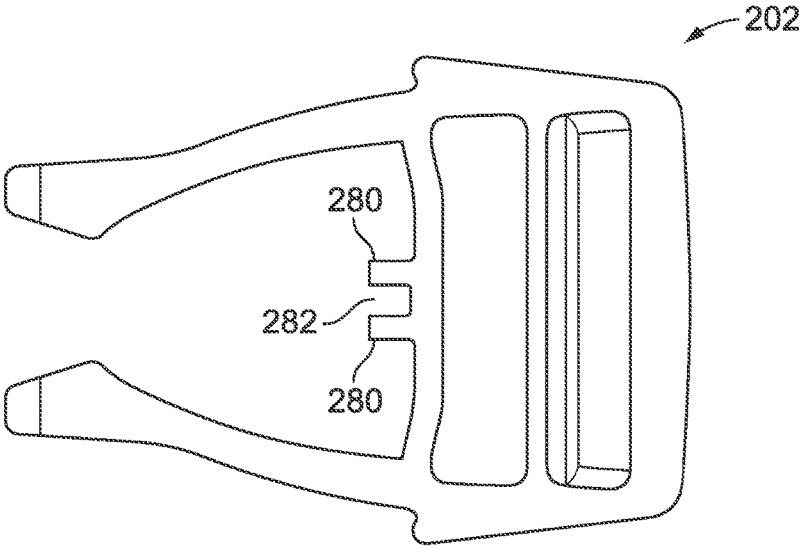
FIG. 13 illustrates a top view of a male connection member, according to an embodiment of the present disclosure.

FIG. 13 illustrates a top view of the male connection member 202, according to an embodiment of the present disclosure. The male connection member 202 may be similar to the male connection member 52, except that prongs 280 that define a guide channel 282 may be shorter. The prongs 280 and the guide channel 282 are configured to mate with the central guide 270 of the female connection member 204 (shown in FIG. 12). Referring to FIGS. 12 and 13, a leading end 290 of the central guide 270 may be rounded or otherwise curved to be readily received within the guide channel 282 from various angles. As the male connection member 202 is urged into the female connection member 204, the male connection member 202 automatically centers as linear inner surfaces of the prongs 280 engage linear side walls 292 of the central guide 270.

Figure 14:
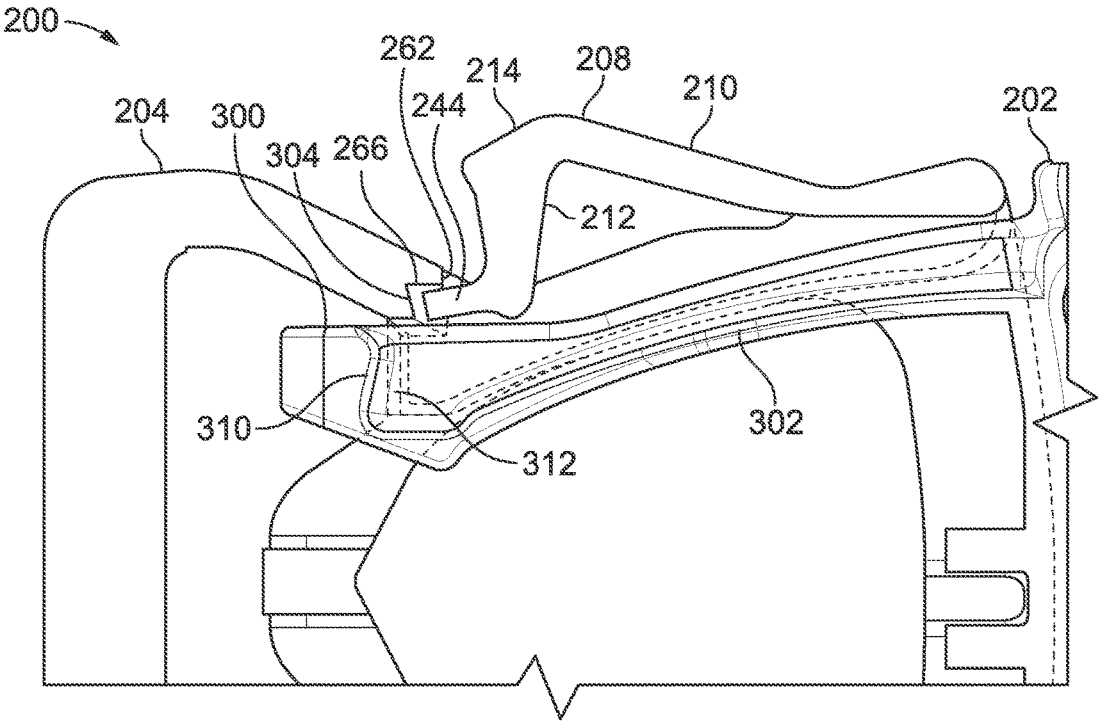
FIG. 14 illustrates locking tips of a locking arm of a male connection member securely engaging a reciprocal ledge of a female connection member, according to an embodiment of the present disclosure.
Figure 15:
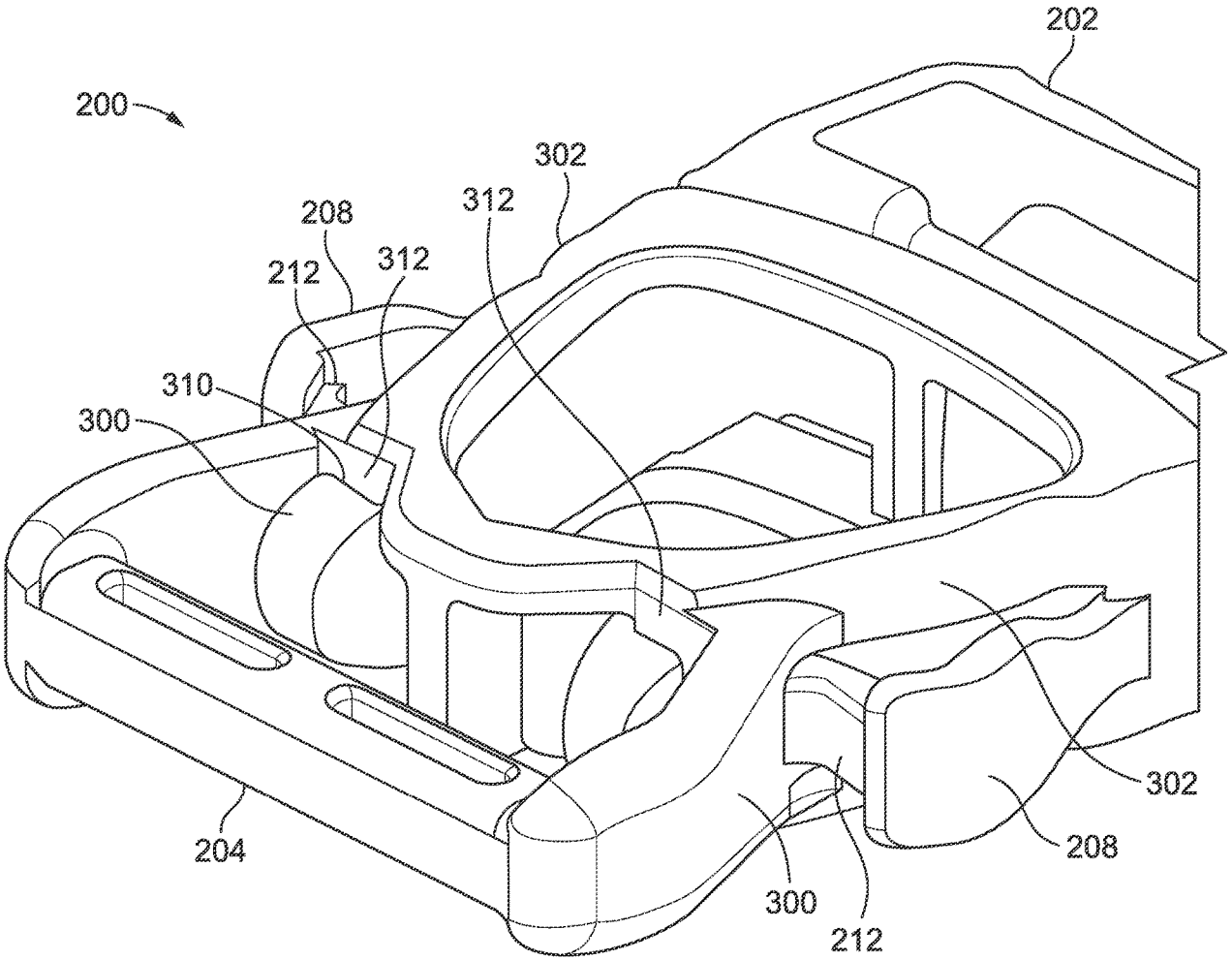
FIG. 15 illustrates an isometric top view of a side-release buckle assembly in a connected state, according to an embodiment of the present disclosure.

FIG. 14 illustrates a locking tip 300 of a locking arm 302 of the male connection member 202 securely engaging a reciprocal ledge 304 of the female connection member 204, according to an embodiment of the present disclosure. FIG. 15 illustrates an isometric top view of the side-release buckle assembly 200 in the connected state. Referring to FIGS. 14 and 15, base edges 310 are formed on the locking tips 300. The base edges 310 abut against a reciprocal ledge 312 formed on the female connection member 202 in order to securely connect the male connection member 202 to the female connection member 204. In order to disconnect the male connection member 202 from the female connection member 204, the pivotal release buttons 208 are squeezed inwardly so that the arm-engaging beams 212 are urged into the locking arms 302, thereby removing the base edges 310 from secure contact with the ledges 312.

Referring to FIGS. 3-15, embodiments of the present disclosure provide buckle assemblies that include female connection members having outer perimeter frames that define central openings. The central openings provide windows that allow for monitoring of alignment and connection between the male and female connection members. Additionally, the central openings allow debris to pass therethrough, so that the buckle assemblies do not become clogged with debris, for example. Further, the central openings provide lighter and less bulky buckle assemblies.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the disclosure disclosed and defined herein extends to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

Various features of the disclosure are set forth in the following claims.

The invention claimed is:

1. A buckle assembly comprising:

a first connection member, wherein the first connection member comprises opposed locking arms configured to removably secure to reciprocal features of the second connection member, and a guide channel defined between first and second prongs; and a second connection member configured to receive at least a portion of the first connection member in order to removably connect the first connection member to the second connection member, wherein the opposed locking arms are configured to removably secure to reciprocal features of the second connection member, wherein the second connection member comprises opposed pivotal release buttons configured to be engaged to remove the opposed locking arms from the reciprocal features, and wherein the second connection member comprises a central guide configured to be received by the guide channel in order to align the first connection member with the second connection member, wherein the central guide includes opposed panels connected together by a central fin, wherein the second connection member includes an outer frame defining a central opening that is configured to allow monitoring of alignment and connection between the first and second connection members, wherein the central opening is formed through at least a portion of a central axis of the second connection member, and wherein the central opening extends on both sides of the central axis, wherein the central opening provides a window into the second connection member that exposes a mating process between the first connection member and the second connection member, wherein the central opening extends over at least half the length and over at least half the width of the second connection member.

2. The buckle assembly of claim 1, wherein the central guide extends into the central opening.

3. The buckle assembly of claim 1, wherein each of the opposed pivotal release buttons comprises a flexible extension beam that connects to an arm-engaging beam through a transition joint, wherein a hook is formed at a distal end of the arm-engaging beam, and wherein the hook is configured to abut into a ledge of the second connection member when the opposed pivotal release buttons are disengaged.

4. The buckle assembly of claim 1, wherein the outer frame includes interior walls that are configured to align the first connection member with the second connection member when the first connection member is mated with the second connection member.

5. The buckle assembly of claim 4, wherein the interior walls include inwardly-curved lateral walls.

6. A buckle assembly comprising:

a female connection member configured to receive at least a portion of a male connection member in order to removably connect the male connection member to the female connection member, wherein the female connection member comprises opposed pivotal release buttons configured to be engaged to remove opposed locking arms of the male connection member from reciprocal features of the female connection member, wherein the female connection member further comprises a central guide configured to be received by a guide channel defined between first and second prongs of the male connection member in order to align the male connection member with the female connection member, wherein the central guide includes opposed panels connected together by a central fin, and wherein the female connection member includes an outer frame defining a central opening that is configured to allow monitoring of alignment and connection between the male and female connection members when the male connection member is mated with the female connection member, wherein the central opening is formed through at least a portion of a central axis of the female connection member, and wherein the central opening extends on both sides of the central axis, wherein the central opening provides a window into the female connection member that is configured to expose a mating process between the male connection member and the female connection member, wherein the central opening extends over at least half the length and over at least half the width of the female connection member.

7. The buckle assembly of claim 6, wherein the central guide extends into the central opening.

8. The buckle assembly of claim 6, wherein each of the opposed pivotal release buttons comprises a flexible extension beam that connects to an arm-engaging beam through a transition joint, wherein a hook is formed at a distal end of the arm-engaging beam, and wherein the hook is configured to abut into a ledge of the female connection member when the opposed pivotal release buttons are disengaged.

9. The buckle assembly of claim 6, wherein the outer frame includes interior walls that are configured to align the male connection member with the female connection member when the male connection member is mated with the female connection member.

10. A buckle assembly comprising:

a male connection member including opposed locking arms and a guide channel defined between first and second prongs; and a female connection member configured to receive at least a portion of the male connection member in order to removably connect the male connection member to the female connection member, wherein the female connection member includes an outer frame defining a central opening that is configured to allow monitoring of alignment and connection between the male and female connection members when the male connection member is mated with the female connection member, wherein the central opening is formed through at least a portion of a central axis of the female connection member, wherein the central opening extends on all sides of the central axis, wherein the central opening provides a window into the female connection member that is configured to expose a mating process between the male connection member and the female connection member, and wherein the central opening extends over at least half the length and over at least half the width of the female connection member, wherein the outer frame includes interior walls that are configured to align the male connection member with the female connection member when the male connection member is mated with the female connection member, wherein the female connection member further includes a central guide configured to be received by the guide channel in order to align the male connection member with the female connection member, wherein the central guide includes opposed panels connected together by a central fin, and wherein the opposed locking arms are removably secured to reciprocal features of the female connection member, and wherein the female connection member further includes opposed pivotal release buttons configured to be engaged to remove the opposed locking arms from the reciprocal features.

11. The buckle assembly of claim 1, wherein the opposed locking arms are longer than the first and second prongs.

12. The buckle assembly of claim 1, wherein the guide channel has an open end, and wherein the first and second prongs are separated from one another by the guide channel.

13. The buckle assembly of claim 6, wherein the opposed locking arms are longer than the first and second prongs.

14. The buckle assembly of claim 10, wherein the opposed locking arms are longer than the first and second prongs.

15. The buckle assembly of claim 1, wherein the first and second prongs are separate and distinct from the opposed locking arms.

* * * * *